United States Patent [19]

Larson

[11] Patent Number: 4,579,332

[45] Date of Patent: Apr. 1, 1986

[54] BOTTOM LEVEL SHEET FEEDING APPARATUS

[75] Inventor: Bradley W. Larson, Garland, Tex.

[73] Assignee: The Mead Corporation, Dayton, Ohio

[21] Appl. No.: 529,455

[22] Filed: Sep. 6, 1983

[51] Int. Cl.[4] ..... B65H 1/06; B65H 3/04; B65H 3/52

[52] U.S. Cl. ..... 271/35; 271/121

[58] Field of Search ..... 271/4, 10, 23, 34, 35, 271/37, 117, 118, 121, 124

[56] References Cited

U.S. PATENT DOCUMENTS

| | | | |
|---|---|---|---|
| 3,768,803 | 10/1973 | Stange | 271/34 |
| 3,869,117 | 3/1975 | Yoshimura | 271/270 |
| 3,895,791 | 7/1975 | Kramell et al. | 271/35 |
| 3,934,869 | 1/1976 | Strobel, Jr. | 271/35 |
| 3,936,046 | 2/1976 | Stange | 271/250 |
| 3,988,017 | 10/1976 | Kyhl | 271/111 |
| 4,014,537 | 3/1977 | Stange | 271/166 |
| 4,025,187 | 5/1977 | Taylor et al. | 355/14 |
| 4,114,870 | 9/1978 | DiBlasio | 271/35 |
| 4,146,219 | 3/1979 | Phillips | 271/233 |
| 4,166,614 | 9/1979 | Hamlin et al. | 271/3.1 |
| 4,174,102 | 11/1979 | Clausing | 271/35 |
| 4,192,497 | 3/1980 | Perun et al. | 271/121 |
| 4,206,995 | 6/1980 | Legg | 355/14 C |

FOREIGN PATENT DOCUMENTS

| | | | |
|---|---|---|---|
| 1216329 | 5/1966 | Fed. Rep. of Germany | 271/35 |
| 1068162 | 12/1952 | France . | |
| 0017037 | 2/1983 | Japan | 271/121 |
| 373945 | 1/1964 | Switzerland | 271/35 |

OTHER PUBLICATIONS

Teeter, Dennis P., et al., "Floating Gate Sheet Separator . . . ", Xerox Disclosure Journal, vol. 7, No. 2, Mar.-/Apr. 1982, p. 67.

*Primary Examiner*—Bruce H. Stoner, Jr.
*Assistant Examiner*—James E. Barlow
*Attorney, Agent, or Firm*—Biebel, French & Nauman

[57] ABSTRACT

A bottom level sheet feeding apparatus having a tray for receiving a stock of sheets, an endless belt conveyor having an upper run which extends into the tray, a lead surface superposed to the upper run of the conveyor downstream of the tray and inclined downwardly and terminating above the upper run to form a pinch point therewith, an idler roller positioned to support the upper run at the pinch point, and a retard strip superposed to the belt downstream of the lead surface. The lead surface has a relatively low coefficient of friction with the sheets to be conveyed, the upper run has a relatively high coefficient of friction with the sheets and the retard strip has a coefficient of friction with the sheets intermediate those of the lead surface and conveyor belt.

10 Claims, 5 Drawing Figures

BOTTOM LEVEL SHEET FEEDING APPARATUS

BACKGROUND OF THE INVENTION

This invention relates to document feeding apparatuses and, more particularly, to bottom level sheet feeding apparatuses.

Many modern, high speed copiers are capable of copying serially paginated booklets and the like, one page at a time, and presenting the copies as well as the copied pages in the proper sequential order. To accomplish this function, such devices commonly utilize bottom level document feeders which receive a stack of original documents to be copied, remove the lowermost sheet from the stack and convey it to the copying station. The advantage of a bottom level document feeder is that successive stacks of original sheets may be loaded into it, even as the sheets are being withdrawn from the lowermost stack, and the resultant copies and originals are presented in the same order in which they were loaded into the device.

There are many types of bottom level documents feeders. For example, Strobel, Jr., U.S. Pat. No. 3,934,869 discloses a bottom level document feeder which includes a stack receiving tray, an endless belt conveyor partially extending into the tray, an abutment plate located downstream of the tray and above the belt, and a retard pad located above the belt and downstream of the abutment plate. The abutment plate is oriented substantially perpendicularly to the portion of the belt conveyor which contacts and transports the sheets loaded onto the tray. The conveyor includes an idler roller located slightly upstream of the abutment plate.

In operation, the conveyor urges a stack of sheets loaded onto the tray forwardly until their leading edges contact the vertical abutment plate. A gap beneath the plate allows the conveyor to displace a lowermost sheet or sheets forwardly beneath the abutment plate and into contact with the retard pad. The retard pad has a coefficient of friction sufficient to hold and thereby separate any additional sheets carried through the opening from the lowermost sheet and prevent their moving further with the lowermost sheet. Thus, only the lowermost sheet is conveyed past the retard pad by the belt, which has a coefficient of friction higher than that of the retard pad and thus can convey a sheet of paper past the retard pad.

Another example of a bottom level document feeder is disclosed in the Kramell et al. U.S. Pat. No. 3,895,791. This sheet feeder comprises an in-feed chute which preferably is sloped between 40° and 60° to the horizontal, a belt positioned the chute and extending into a paper feeding tray, an intermediate roller positioned beneath the chute, and a retard pad positioned downstream of the chute. The in-feed chute of this device does not form a pinch point with the conveyor since it is pivotally mounted to the machine supporting the belt and rollers, and therefore can pivot upwardly away from the sheets being fed. A weight is mounted on the in-feed chute to urge it downwardly so that only a lowermost sheet or sheets is conveyed by the belt beneath the in-feed chute to the retard pad.

A problem inherent with many bottom level document feeding apparatuses is that the conveying means for transporting the lowermost sheet from the stack within the paper tray often conveys more than a single sheet so that a number of sheets pass the abutment plate located downstream of the paper tray and are conveyed past the retard to the station. This results in misfeeds and requires the sheet feeding operation to be stopped and the excess sheets removed from the apparatus downstream of the stack. An excessive number of such misfeeds results in significant downtime of the entire copying or duplicating machine, and possibly an unacceptable number of copy sheets which have either no text at all imprinted upon them, or text which is misregistered.

Accordingly, there is a need for a bottom level document feeding apparatus which is relatively simple and economical to manufacture and service. There is also a need for a bottom level document feeding apparatus which is relatively reliable in that it rarely allows more than the lowermost sheet of a stack to be removed therefrom and transported to a next subsequent station.

SUMMARY OF THE INVENTION

The present invention provides a bottom level sheet feeding apparatus which does not require moving parts other than an endless belt conveyor, and therefore is relatively inexpensive to manufacture and maintain in proper working order. Furthermore, the present invention provides a sheet feeding apparatus which is reliable relative to prior art devices and therefore minimizes machine downtime and waste.

The present invention is a bottom level sheet feeding apparatus which includes a tray for receiving a stack of sheets, a feed belt extending partially into the tray, a lead surface plate superposed to the belt conveyor downstream of the tray and inclined upwardly from the belt to form a pinch point therewith, an idler roller positioned to support the belt directly beneath the pinch point, and a conformable retard strip superposed to the belt conveyor downstream of the lead surface plate. The outer surface of the belt comprising the belt conveyor has a relatively high coefficient of friction for conveying a lowermost sheet of a set of sheets in the tray from the tray through the pinch point and past the retard strip. The lead surface plate has a relatively low coefficient of friction against the paper sheets so as to allow the sheets to move downwardly as successive ones of the lowermost sheets of the set are conveyed downstream of the tray by the belt. The retard strip has a coefficient of friction against paper which is lower than that of the belt but higher than that between overlying sheets so that sheets superposed to the lowermost sheet passing through the pinch point are retained by engagement of their leading edges and upper surfaces with the retard strip and are prevented from being conveyed further downstream by the belt. When a set of sheets is placed within the tray and urged downstream by the belt conveyor, their leading edges contact the lead surface, and the sheets are wedged downwardly toward the pinch point for separation. For this purpose, the lead surface plate preferably makes an angle with the feed belt which is between about 40° and 50°.

Although the present invention will function satisfactorily when the upper run of the belt conveyor is substantially horizontal, the efficiency is optimized when the feeding apparatus is arranged such that the upper run of the belt conveyor is inclined downwardly from the receiving tray, preferably making an angle of about 10° with the horizontal. In a preferred embodiment, the retard strip is made of a thin, microcellular, polyurethane foam and is mounted to the bottom surface of a block of foam or other relatively flexible spongy material. A retard strip of this construction can be mounted to the sheet feeding apparatus such that the foam strip rests lightly upon the portion of the upper run directly beneath it. As sheets are conveyed between the retard strip and the belt, the leading edges of the sheets superposed to the lowermost sheet engage the retard strip successively, and form a stepped arrangement. The flexibility of the spongy material supporting the retard strip permits the retard strip to conform to this stepped configuration and prevent the sheets superposed to the lowermost sheet from being conveyed further.

Accordingly, it is an object of the present invention to provide a bottom level sheet feeding apparatus which is relatively inexpensive to fabricate and service once installed in a document handling system; a sheet feeding apparatus which has relatively few moving parts yet is highly reliable; a sheet feeding apparatus which is relatively efficient and minimizes downtime and waste; and a sheet feeding apparatus which does not require closely toleranced parts in order to maintain a high operating efficiency.

Other objects and advantages of the invention will become apparent from the following description, the accompanying drawings and the appended claims.

DESCRIPTION OF THE PREFERRED EMBODIMENTS

Figures 1, 2, 3:
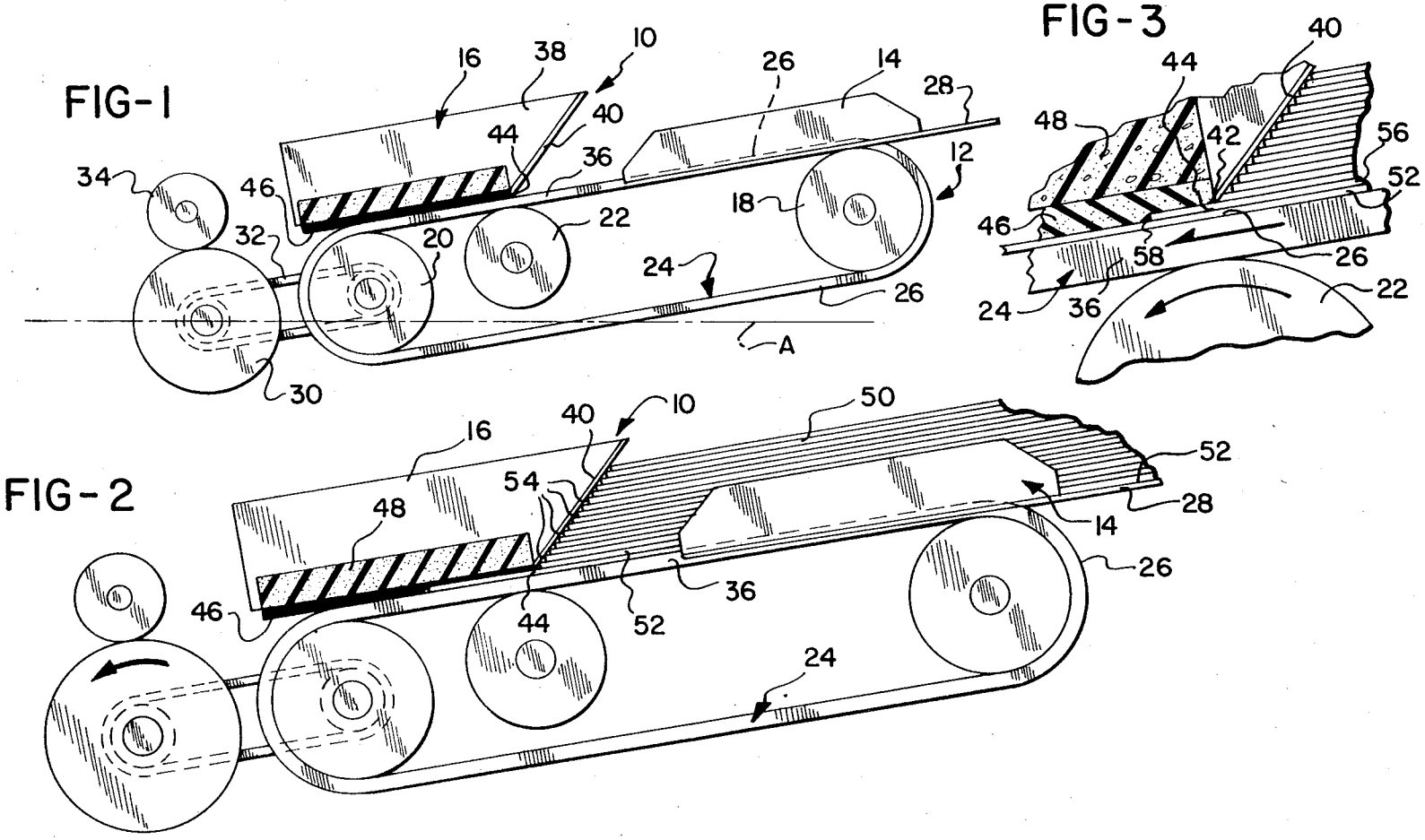
FIG. 1 is a somewhat schematic side elevation of the bottom level sheet feeding apparatus of the invention.
FIG. 2 is a side elevation of the apparatus of FIG. 1 in which a set of sheets is shown in the tray.
FIG. 3 is a detail of the apparatus of FIG. 2 showing the pinch point.

As shown in FIG. 1, the bottom level sheet feeding apparatus, generally designated 10, comprises a belt conveyor 12, a sheet receiving tray 14, and a pad mounting block 16. The belt conveyor 12 includes a rearward roller 18, positioned beneath the tray 14, a forward driven roller 20, positioned beneath the pad mounting block 16, and an idler roller 22. A belt 24 is entrained about the rollers 18, 20 and 22 and includes an outer surface 26 which, when passing through the tray 14, is elevated slightly above the floor 28 so that it may engage sheets contained therein.

The outer surface 26 of the belt 24 preferably has a relatively high coefficient of friction when contacting a sheet of paper. Particularly desirable results may be obtained with coefficients of between 1.2 to 1.5. A preferred material is isoprene.

The drive roller 20 is operatively connected to a lower pinch roller 30 by a belt 32. The lower pinch roller 30 engages an upper pinch roller 34 and is driven by a motor (not shown) in a manner well-known in the art. The pinch rollers 30, 34 operate to convey single sheets emerging from the mounting block 16 downstream to the associated copying apparatus (not shown), and do not constitute a part of the invention.

As shown in FIG. 1, the tray floor 28 and upper run 36 of the conveyor belt 24 together define a paper path which is inclined downwardly from the tray 14 at an angle relative to the horizontal, represented by line A. Optimum results have been achieved when this angle of inclination is approximately 10°, although angles as high as 80° have yielded satisfactory results.

The pad mounting block 16 includes a body 38 having a lead surface plate 40 mounted to the end thereof which faces the tray 14. The lead surface plate 40 is inclined upwardly from belt 24 and makes an angle with the upper run 36 of between 30° and 60° and more preferably between 40° and 50°. Optimum results have been achieved when this angle is very close to 45°. The lead surface plate is made of a material having a relatively low coefficient of friction with paper, such as, for example, a beryllium copper alloy or an ultra high molecular weight material such as acetal resin. Preferably the coefficient of friction against paper is 0.2 or less.

As shown in FIGS. 1 and 3, the lead surface plate 40 includes a lower edge 42 which is located above belt 24 at a position so as to lightly contact outer surface 26 along a line directly above the idler roller 22. The idler roller 22 supports the belt 24 directly beneath the lower edge to form a pinch point 44 for inhibiting the passage of multiple sheets of paper.

The pad mounting block 16 also includes a retard strip 46 which extends from the lower edge 42 of the plate 40 downstream beneath the body 38. The retard strip 46 is supported above the upper run 36 by a relatively flexible sponge block 48 which is attached to the body 38. The retard strip is made of a material having a coefficient of friction against paper that is somewhat less than the coefficient of friction of the outer surface 26 of the belt 24. A frictional coefficient of about 0.5 has been found to be satisfactory. A preferred material is a strip of microcellular polyurethane foam approximately 0.030 inches (0.762 mm.) thick.

Figure 4:
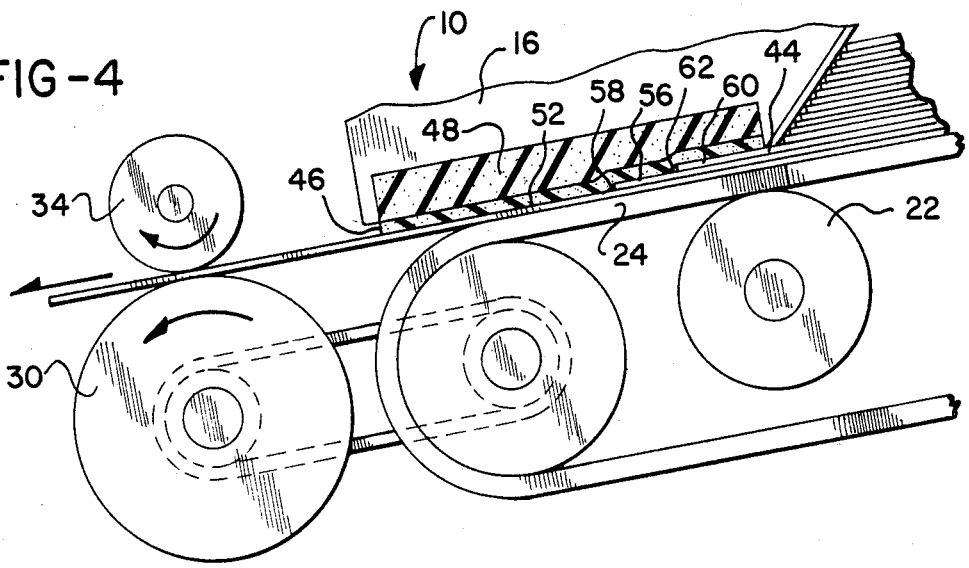
FIG. 4 is a detail of the apparatus of FIG. 3 showing sheets engaging the retard strip.

The operation of the sheet feeding apparatus 10 is best shown in FIGS. 2, 3 and 4. Initially, a stack of sheets 50 is placed in the tray 14 so that a lowermost sheet 52 rests upon the floor 28 and the portion of the upper run 36 of the belt within the tray. The linear movement of the upper run 36 urges the sheets forwardly toward the pad mounting block 16 thereby causing the sheet leading edges 54 to come into contact with lead surface plate 54. Thereafter, continuing forward movement of the sheets during the feeding operation causes the sheets to be wedged forwardly and downwardly between plate 54 and belt 24 and shingled into the nip 44. The inclination of upper run 36 reduces inter-sheet frictional coupling forces and facilitates the forward and downward wedging of the sheets.

As best shown in FIG. 3, continued movement of the belt 24 conveys the lowermost sheet 52 through the pinch point 44 where it passes between the outer surface 26 of the upper run 36 and the retard strip 46. Since the retard strip 46 is attached to the relatively flexible sponge block 48, the retard strip can deform away from the outer surface 26 to allow the passage of the lowermost sheet 52 therebetween.

Should a sheet 56, immediately above the lowermost sheet 52, pass through the pinch point 44 as well, as shown in FIG. 3, the leading edge 58 and upper surface of this sheet will contact the retard strip 46 and be held thereby, thus separating from the lowermost sheet 52. This is accomplished because the coefficient of friction between the sheet 56 and the retard strip 46 is greater than the coefficient of friction between the sheet 56 and lowermost sheet 52. Furthermore, the coefficient of friction between the lowermost sheet 52 and the outer surface 26 of the belt 24 is greater than the coefficients of friction between the lowermost sheet and either the retard strip 46 or sheet 56. Thus, the lowermost sheet 52 is conveyed by the belt 24 past both the sheet 56 and retard strip 46.

In the event that a third sheet 60 is conveyed through the pinch point 44, as shown in FIG. 4, the retard strip 46 will deform to engage the leading edge 62 of that sheet and likewise prevent it from being conveyed downstream of the pad mounting block 16 to the pinch rollers 30, 34 with the lowermost sheet 52. Since the sponge block 48 is sufficiently flexible, the retard strip 46 is permitted to deform in a stepped configuration to engage and retain additional sheets that may pass through the pinch point 44, thereby separating them from the lowermost sheet 52.

Figure 5:
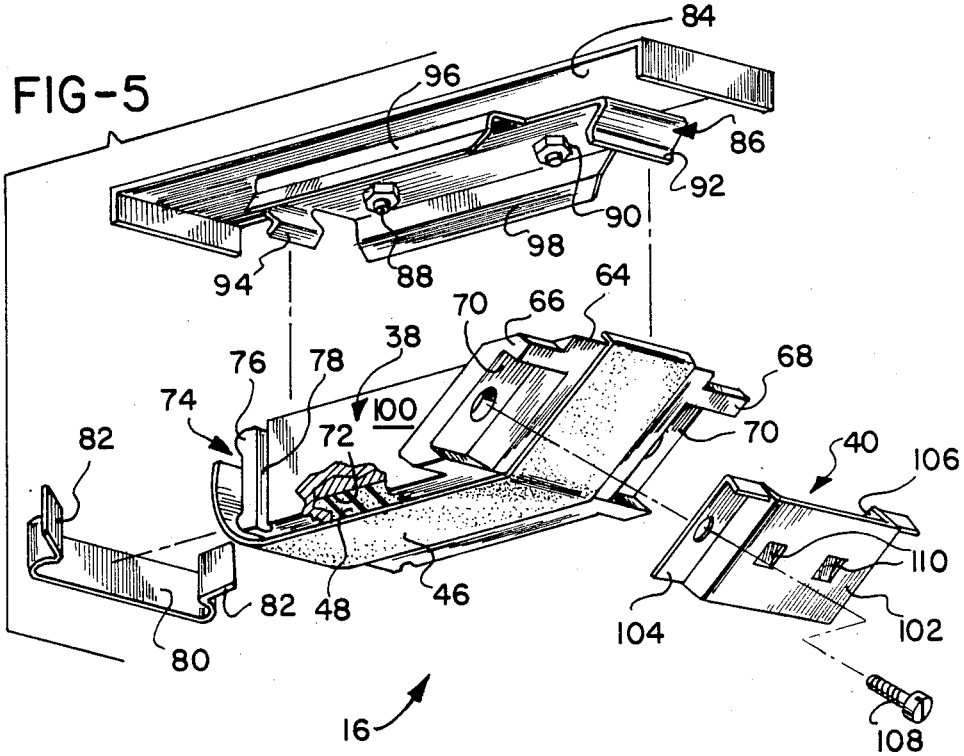
FIG. 5 is an exploded, perspective view of a preferred embodiment of the pad mounting assembly of the apparatus of FIG. 1.

As shown in FIG. 5, the preferred structure of the pad mounting block 16 includes a body 38 having a front face 64 which is inclined at the appropriate angle to the belt 24 (FIG. 1) and a pair of lateral flanges 66, 68, each having a recess 70. The sponge block 48 is mounted within a lower recess 72. The trailing edge 74 of the body 38 includes an upper transverse ridge 76 and a pair of vertical grooves 78 (only one of which is shown in FIG. 5). A rear clip 80 includes wings 82 which are sized and positioned to resiliently engage the vertical grooves 78.

The body 38 is attached to the support structure 84 of the associated paper handling apparatus (not shown) by a mounting bracket 86 which is secured to the supporting structure by bolts 88, 90. The mounting bracket 86 includes front and rear clips 92, 94, respectively, and lateral clips 96, 98. The front clip is sized and positioned to resiliently engage the front edge 64 of the body 38, and the rear clip 94 is positioned to resiliently engage the upper transverse ridge 76 of the trailing edge 74. Similarly, the lateral clips 96, 98 resiliently engage the side panels 100 of the body 38 (only one of which is shown in FIG. 5). Thus, the body 38 can be attached or removed relatively easily without the use of tools.

The lead surface plate 40 includes a lead surface 102 and side flanges 104, 106 which are offset from the lead surface and are received within the recesses 70 of the lateral flanges 66, 68 by screws 108 (only one of which is shown).

The retard strip 46 extends about the periphery of the body 38 and is secured to the front surface 64 by the lead surface plate 40, which includes punched out prongs 110 which engage the strip and prevent its movement downwardly as a result of engagement with moving sheets of paper or the belt 24 (FIG. 1). The rear clip 80 holds the trailing edge of the strip 46 against the trailing edge 74 of the body 38. Thus, the strip can be adjusted to present an unworn surface to a sheet passing thereunder by displacement of the strip relative to the body 38. This displacement can be accomplished relatively easily by removing the rear clip 80 and lead surface plate 40, adjusting the position of the strip 46 relative to the body 38, then reattaching the clip and plate.

While the forms of apparatus herein described constitute preferred embodiments of this invention, it is to be understood that the invention is not limited to these precise forms of apparatus, and that changes may be made therein without departing from the scope of the invention.

What is claimed is:

1. A bottom level sheet feeding apparatus comprising:

tray means for receiving a stack of sheets;

endless belt conveyor means including an upper run having an upstream end extending into said tray means;

lead surface means superposed to said conveyor means downstream of said tray means, said lead surface means being inclined downwardly with respect to said conveyor means and forming a pinch point therewith;

retard strip means superposed to said belt and positioned downstream of said lead surface means and having a strip of foam and a relatively deformable backing such that said strip may conform to a stepped contour of a plurality of sheets passing through said pinch point;

a body having an inclined front edge mounting said inclined surface means such that an end of said strip means is clamped therebetween, a lower recess for receiving said backing, and a trailing end having a pair of opposing vertical grooves;

a rear clip having opposing wings sized to resiliently engage said grooves for clamping an opposite end of said strip means to said trailing end of said body; and mounting bracket means for resiliently attaching said body to an associated support structure.

2. The apparatus of claim 1 wherein said lead surface means forms an angle with said upper run of said conveyor means of between 30° and 60°.

3. The apparatus of claim 2 wherein said lead surface means angle is about 45°.

4. The apparatus of claim 2 wherein said upper run of said conveyor means is inclined downwardly from said receiving means at an angle of about 10° with the horizontal.

5. The apparatus of claim 4 wherein said lead surface means has a coefficient of friction against said sheets which is not greater than about 0.2.

6. The apparatus of claim 5 wherein said retard strip means contacts said outer surface of said upper run.

7. The apparatus of claim 6 wherein said outer surface of said lead surface means is made of a beryllium copper alloy.

8. The apparatus of claim 6 wherein said conveyor means has an outside surface having a coefficient of friction with paper of between 1.2 and 1.5.

9. The apparatus of claim 7 wherein said retard strip means is made of a microcellular polyurethane foam.

10. A bottom level sheet feeding apparatus comprising:

tray means for receiving a stack of sheets;

endless belt conveyor means including an upper run having an upstream end extending into said tray means and an outer surface with a relatively high coefficient of friction for transporting a stack of sheets from said receiving means, said upper run inclined downwardly from said tray means approximately 10° with respect to the horizontal;

lead surface means superposed to said upper run of said conveyor means downstream of said tray means, said lead surface means being inclined downwardly at an angle of approximately 45° with respect to said upper run to form a wedge shape therewith and terminating at said upper run to form a pinch point therewith and having an outer surface made of a beryllium copper alloy material having a relatively low coefficient of friction;

idler roller means positioned to support said upper run beneath said pinch point to maintain said pinch point at said height;

retard strip means superposed to said belt and positioned downstream of said lead surface means and having a strip of microcellular polyurethane foam contacting said outer surface of said upper run and a relatively deformable backing such that said strip may conform to a stepped contour of a plurality of sheets passing through said pinch point;

a body having an inclined front edge mounting said lead surface means such that an end of said strip means is clamped therebetween, a lower recess for receiving said backing, and a trailing end having a pair of opposing vertical grooves;

a rear clip having opposing wings sized to resiliently engage said grooves for clamping an opposite end of said strip means to said trailing end of said body; and mounting bracket means for resiliently attaching said body to an associated support structure.

* * * * *